United States Patent [19]

Pien

[11] 4,306,839

[45] Dec. 22, 1981

[54] SEMI-TANDEM MARINE PROPELLER

[75] Inventor: Pao C. Pien, Washington, D.C.

[73] Assignee: The United States of America as represented by the Secretary of the Navy, Washington, D.C.

[21] Appl. No.: 68,982

[22] Filed: Aug. 23, 1979

[51] Int. Cl.[3] ..... B63H 1/20

[52] U.S. Cl. ..... 416/200 R; 416/203; 416/238

[58] Field of Search ..... 416/238, 200 R, 198 R, 416/203

[56] References Cited

U.S. PATENT DOCUMENTS 3,791,762 2/1974 Brehme ..... 416/200 X

*Primary Examiner*—Stephen C. Bentley

*Attorney, Agent, or Firm*—Robert F. Beers; William T. Ellis; Kenneth E. Walden

[57] ABSTRACT

This invention is directed to an improved tandem marine propeller having two sets of radially extending blades which are connected at their roots to a hub in tandem arrangement for minimizing drag adjacent the hub and having the blades configured by skewing one set forward and the other set backward and raking the blades of the two sets toward each other so that outer portions of the blades are equispaced radially about the hub and lie substantially in a common plane of rotation whereby loading on the blades of both sets is substantially equalized for increased efficiency.

8 Claims, 6 Drawing Figures

SEMI-TANDEM MARINE PROPELLER

The invention described herein may be manufactured and used by or for the Government of the United States of America for any governmental purposes without the payment of any royalties thereon or therefor.

BACKGROUND OF THE INVENTION

The semi-tandem propeller according to this invention arises from modifications of a conventional tandem propeller to achieve significantly improved operating efficiency.

Based on research performed at the David W. Taylor Naval Ship Research and Development Center, Bethesda, Md. it was determined in one case that the open-water characteristics of a tandem propeller with twice the number of blades of a single propeller is approximately 4% higher than that of a single propeller. For the same thrust loading, there is less kinetic energy in the slipstream which may explain the higher efficiency of a tandem propeller.

More uniformity of propeller loading over the whole propeller disk can be obtained by increasing the number of blades of a single propeller. Theoretically, in an inviscid fluid, optimum propeller efficiency increases with an increase in the number of blades. For purpose of illustration, when the advance coefficient is equal to 0.3 and the ideal thrust coefficient is equal to 1.0, the relationship between the number of blades and the ideal propeller efficiency is substantially as follows:

| No. of Blades | Propeller efficiency (ideal) |
|---|---|
| 2 | .60 |
| 3 | .68 |
| 4 | .70 |
| 6 | .73 |
| 8 | .75 |
| ∞ | .78 |

The reason that ideal propeller efficiency is increased with an increase in the number of blades can be understood from a simple momentum theory. To produce a given thrust, the propeller efficiency depends upon the induced axial velocity distributed over the propeller disc defined by the area circumscribed by the revolving blades. If the axial velocity induced in the fluid is a constant over the whole disk area, the least kinetic energy is left in the slipstream and, thereby, optimum ideal efficiency is obtained. A finite number of blades achieve a constant induced velocity only along each blade. The uniformity of velocity over the area of the whole propeller disk can be improved by increasing the number of blades.

The theoretical advantage of increased efficiency by increasing the number of blades is, unfortunately, not assured in practical applications, where it has been found in viscous fluids, such as water, for example, that an increase in blades may actually result in efficiency loss. As the number of blades increase, the passages between the blade is constricted, particularly near the hub. Water velocity through these passages has to be increased, and, as a result, blade viscous drag increased. Another problem encountered with conventional tandem propellers is that loading on forward and aft propeller blades is not equalized because they operate in different inflow fields since one is axially ahead of the other. Since propeller loading is mainly carried over the outer portion of the disk area, optimum setting of the blade outer portions, including their substantial alignment in a common plane of propeller rotation, is desirable. This may be achieved by the semi-tandem propeller configuration described herein.

SUMMARY OF THE INVENTION

The present invention relates to an improved marine propeller, and more specifically relates to a tandem propeller wherein the blades are configured in a manner to achieve the full advantage of the increased number of blades for higher efficiency without witnessing substantially increased drag adjacent the hub caused by the increased number of blade attachments. The sets of blades are attached to the hub at their roots in tandem, substantially one behind the other, in a manner resulting in no substantial drag increase over the drag of a single set of blades. The blades of each set are skewed in opposite hand and raked toward one another so that outer portions of the blades are equispaced in the plane of propeller rotation for increased propeller efficiency.

An object of this invention is to define an improved marine propeller.

Another object of this invention is to define a propeller having the advantage of a greater number of blades for lighter individual blade loading and increased efficiency, but without the disadvantage of increased drag adjacent the hub caused by the greater number of blades.

Still another object of this invention is to define an improved tandem bladed marine propeller wherein the blades are skewed and raked in a manner and to an extent whereby outer portions of the blades of both sets lie substantially equispaced in a common plane of propeller rotation for equalized blade loading and increased propeller efficiency.

Yet another object of this invention is to define a propeller having lighter blade loading, higher efficiency, reduced cavitation, and reduced propeller and induced hull vibrations.

Other objects of the invention are defined in the description of this specification and in claims supported thereby.

DESCRIPTION OF THE PREFERRED EMBODIMENT

Figure 1:
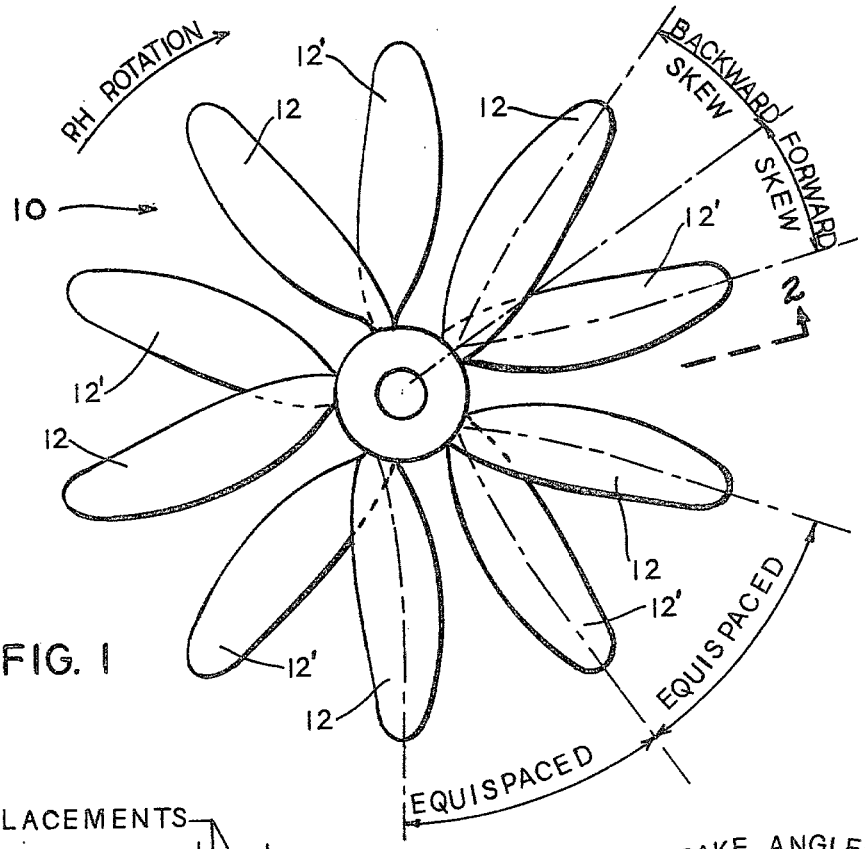
FIG. 1 is an end view of a propeller having blades configured and arranged according to the invention.
Figure 5:
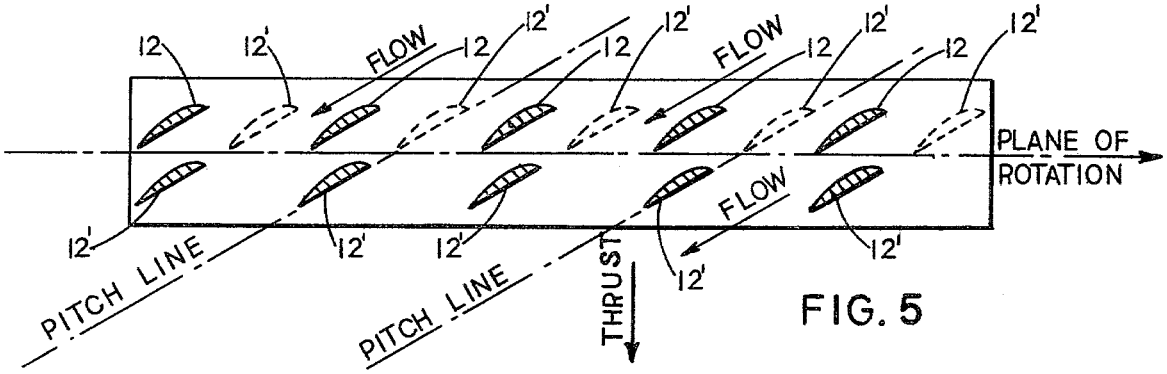
FIG. 5 is a development of the surface of the hub shown in FIG. 1 and illustrating how the ten blade root attachments of FIG. 4 are rearranged in tandem to reduce drag according to the present invention.

A propeller according to the present invention has a high number of blades to obtain the advantage of lower individual blade loading and higher overall efficiency. There is shown in FIG. 1, an end or stern view of a propeller 10 having ten blades, 12, 12' arranged in two sets of five blades each attached to hub 14 in tandem. Any even number of blades made up of two sets may comprise the full propeller complement. Blades of the sets with root attachments nearest the viewer in FIG. 1 are identified by the numeral 12, whereas blades with root attachments fartherest from the viewer are identified by the numeral 12'. Blades 12 of one set are skewed backward from their root attachments 16, whereas blades 12' of the other set are skewed forward from their root attachments 16'. Skewing identifies a relative relationship. For example, when a blade tip is identified as skewed backward relative to the blade root, the blade root may be said to be skewed forward relative to the blade tip. As shown in FIG. 1, hub 14 is relatively free of blade blockage. The ten blades at their roots occupy substantially no more frontal area than five blades of one set. Accordingly, frictional drag on water passing adjacent the hub is not substantially increased. The exact arrangement in which the blade roots are attached to the hub is illustrated in FIG. 5. Blades 12, 12' of the two sets may be considered to lie in tandem at their inner portions near where they attach to the hub in a relationship which causes no substantial frictional loss over one set alone.

Figure 2:
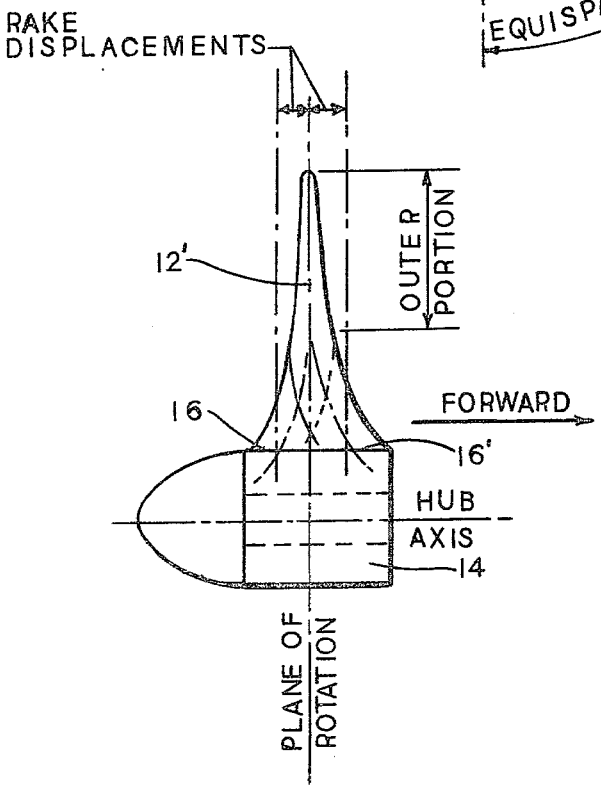
FIG. 2 is a partial side view of the propeller hub and two blades taken generally along line 2 in FIG. 1.

Propeller 10, as viewed in FIG. 1, is arranged for right hand rotation. Each blade outwardly of its inner portion or root is provided with compound shapes that tend to detract from a true tandem relationship of the sets—hence, the term semi-tandem propeller. Blades 12, whose roots are nearest the viewer of FIG. 1, comprise one set of five blades and are skewed backward at their outer portions, i.e., in opposite hand to the direction of propeller rotation. Blades 12', the roots of which are fartherest from the viewer, comprise the other set of five blades. They are skewed forward at their outer portions, i.e., in the direction of rotation. The extent of skew applied to the blades of each set is such that tips and outer portions of the blade of opposed set are equispaced as illustrated in FIG. 1. Blades 12 and 12' of each set are also curved or displaced toward each other to establish at their outer portions a rake or rake displacement. This is illustrated in FIG. 2. Preferably each set of blades is displaced toward the other from their roots to establish equal rake displacement, but it is possible for the blades of one set only to be raked all the way toward the other set for establishing coincidence on a common plane of propeller rotation.

Figure 3:
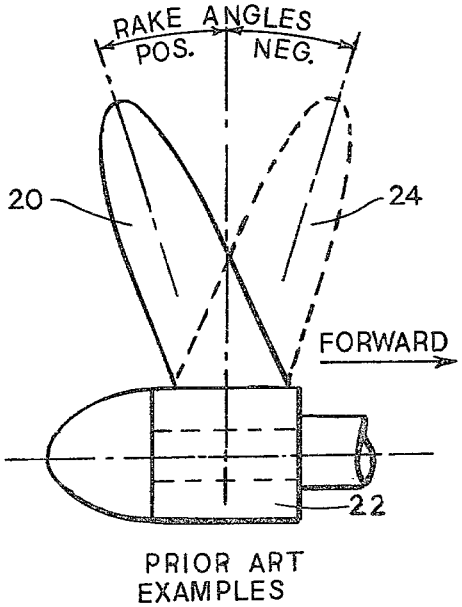
FIG. 3 is a partial side view of a prior art propeller with a blade shown in two positions for illustrating positive and negative rake angles.

FIG. 3 is a drawing, forming no part of the present invention, for illustrating positive and negative rake. Rake is usually the angular displacement of the axes such as that of blade 20 or blade 24 in deviation for a plane of rotation. The term rake may be used in a broader sense to identify offset as well as angular displacement. Hence, the broader term rake displacement is used in FIG. 2 to identify a lateral or axial displacement of the blade outer portion.

Therefore, the propeller 10 configuration is that of two sets of blades 12 and 12' attached in tandem at their roots and skewed in opposite hand and provided with rake displacement toward each other so that outer portions of the blades are equispaced substantially in a common plane of rotation whereby each blade has a face positioned to operate in the same inflow field for equal loading.

Figure 4:
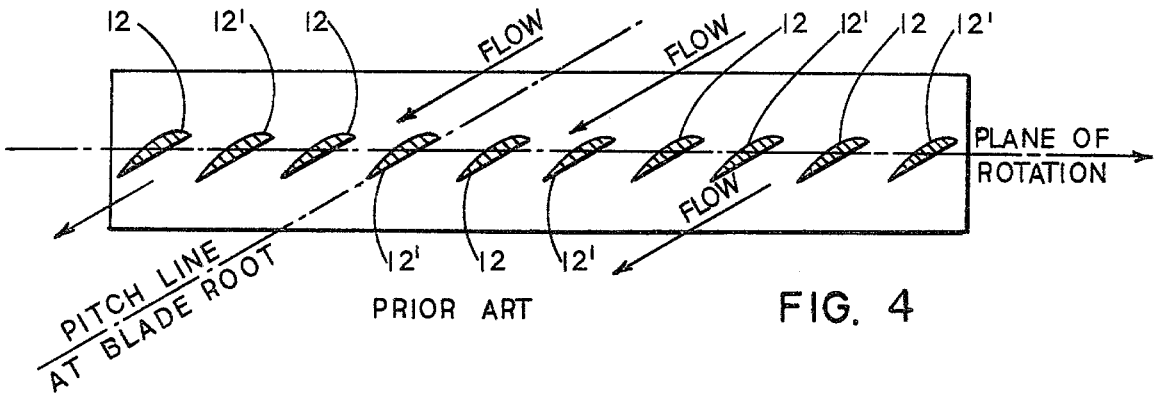
PRIOR ART FIG. 4
FIG. 4 is a prior art representation of a cylindrical propeller hub developed to illustrate the congestion of ten blade root attachments.

FIG. 4 shows a development of the surface of a prior art cylindrical hub, similar in size to hub 14 disclosed in FIG. 1 and FIG. 2. The purpose of the hub surface development is to illustrate the congestion caused at the hub when ten blades, the same number of blades as carried by hub 14 in FIG. 1, are attached in the same plane of rotation. The passages between the blades at their roots are very narrow and require high velocity of water passing near the hub. As a result, viscous drag increases, and there is a corresponding decrease in propeller efficiency. FIG. 5 represents a development of hub 14 showing how ten blades are attached to the hub with substantially less flow restriction. For ease in understanding the blade root arrangement according to the objectives of the invention, consider that every other blade (e.g. blades 12') in FIG. 4, are moved downwardly along their pitch lines to positions substantially behind, aligned, or in tandem with blades 12 as shown in FIG. 5. It is preferable that blades 12 and 12' be separated to an extent so that blades 12', for example, do not block the throat or passage between adjacent blades 12, and vice versa. Several factors are involved, such as blade width, pitch angle and hub length for determining the spacing between tandem blades. One blade may not fall exactly behind the other. The term tandem defines a blade relationship, substantially as illustrated, whereby viscous drag is minimized. Obviously, the FIG. 5 arrangement causes less drag then the FIG. 4 arrangement. In fact, the drag encountered by water flowing past the hub in FIG. 5 is not substantially greater than drag past the hub of a single five bladed propeller.

Figure 6:
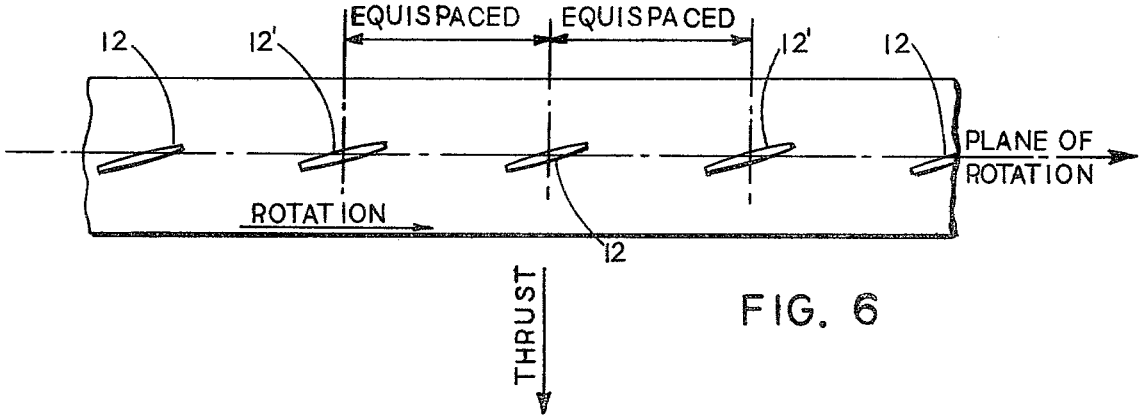
FIG. 6 is a development of several blade tips in end view illustrating their equispacing and lie in a common plane.

As previously described, blades 12, 12' are skewed and raked so that their outer portions are equispaced from each other and lie substantially in a common plane of propeller rotation. This is shown in FIG. 6, which is a development looking down on the tips of several propeller blades. By this arrangement, the influence of one set of blades on the other set, and vice versa, is the same. They are each subjected to substantially equal inflow conditions. Blade loading, therefore, is substantially equalized, and thrust over the whole disk area is more even.

Obviously many modifications and variations of this invention are possible in light of the above teachings. While this invention has been shown and described with two sets of propeller blades attached to the hub, it is conceivable however, that a plurality of sets such as three for example, could be employed. The blades of three sets would be connected at their roots to the hub and spaced apart from one another along their pitch lines in the manner illustrated for two sets as shown in FIG. 5. The blades of the center set would extend radially outwardly without skew or rake whereas the blades of the sets on either side would be skewed forward and backward, as shown in FIG. 1, and raked toward the center set. It is therefore to be understood that within the scope of the following claims the invention may be practiced otherwise than as specifically described.

What is claimed is:

1. A marine screw propeller comprising:

a unitary hub having an axis of rotation and adapted for mounting on a rotatable shaft;

plural sets of radially extending blades attached at their roots to the unitary hub in axial tandem for reducing drag in water flow past the hub;

the blades of one set having forward skew and the blades of another set having backward skew to an extent so that outer portions of the blades are substantially equispaced about the hub;

at least one set of blades having rake displacement toward another set of blades to an extent so that the outer portions of the blades of the sets lie substantially in a common plane of rotation transverse to the unitary hub axis;

whereby loading on the blades of each set is substantially equalized.

2. The invention according to claim 1 wherein the plural sets of blades comprises two sets.

3. The invention according to claim 2 wherein the blades of both sets are displaced toward each other whereby blade outer portions lie substantially in said common plane.

4. The invention according to claim 3 wherein the common plane is disposed midway between blade roots of respective blade sets.

5. A marine screw propeller having a relatively high number of blades comprising:

a unitary hub adapted to be attached to a shaft for rotation about its axis;

two sets of radially extending blades attached at their roots to the unitary hub in tandem to minimize water drag adjacent the hub;

the blades of the sets having skews of opposite hand and having rake displacement toward each other whereby outer portions of the blades lie substantially equidistant from each other radially about the hub in substantially a common plane of rotation transverse to the hub axis for equalized blade loading for maximizing propeller efficiency.

6. A marine screw propeller comprising:

a unitary hub having an axis and adapted for mounting on a shaft for rotation;

plural sets of blades of at least three blades each;

said blades having root portions attached to the unitary hub and having radially extending outer portions equispaced in a common plane of rotation;

the blades of one set having their root attachments to the unitary hub substantially axially aligned behind respective blade root attachments of another set;

thereby minimizing water drag adjacent the hub by presenting to the water adjacent the hub root attachments only the frontal area of one set of blades.

7. The invention according to claim 6 further defined by the plural sets of blades comprising at least four blades each.

8. The invention according to claim 7 further defined by two sets of blades comprising five blades each.

* * * * *